United States Patent [19]

Raymond

[11] Patent Number: 4,793,545

[45] Date of Patent: Dec. 27, 1988

[54] EMBEDDED TRACK ASSEMBLY

[75] Inventor: Ronald P. Raymond, Cleveland, Ohio

[73] Assignee: Construction Polymers Company, Cleveland, Ohio

[21] Appl. No.: 72,967

[22] Filed: Jul. 14, 1987

[51] Int. Cl.[4] ..... E01B 1/00

[52] U.S. Cl. ..... 238/8

[58] Field of Search ..... 238/8

[56] References Cited

U.S. PATENT DOCUMENTS

| | | | |
|---|---|---|---|
| 1,755,698 | 4/1930 | Lish | 238/8 |
| 3,469,783 | 9/1969 | Uralli et al. | 238/8 |
| 3,955,761 | 5/1976 | Szarka et al. | 238/8 |
| 4,289,273 | 9/1981 | Schmidt | 236/8 |

OTHER PUBLICATIONS

"Saf&dri Railroad Grade Crossings" Structural Rubber Products Co., p. 4, 10/82.

"Goodyear Super-Cushion Rubber Crossings for Highways", Goodyear Tire and Rubber Co. 07/85.

*Primary Examiner*—A. Michael Chambers

*Attorney, Agent, or Firm*—Fay, Sharpe, Beall, Fagan, Minnich & McKee

[57] ABSTRACT

An embedded track construction for a transit railway including first and second parallel, spaced rails extending an indefinite length in a first longitudinal direction. A composite insert assembly extends along the indefinite length of the rails to electrically insulate the track rails from the surrounding ground surface. The composite insert also provides a positive water seal and allows lateral movement of the rail. The inserts include a first generally rigid channel and an elastomeric member received thereon. The rigid channel preferably defines an inverted, generally U-shaped configuration in which one leg is interposed between the top and bottom flanges of the rails. A second leg abuttingly engages conventional support ties that are perpendicularly disposed to the transit rails. Gauge side inserts include a cut-out formed in the elastomeric member to receive an associated wheel flange. The inserts facilitate crossing of the railway in a transverse direction, as well as travel in the longitudinal direction by emergency vehicles or the like.

21 Claims, 5 Drawing Sheets

EMBEDDED TRACK ASSEMBLY

BACKGROUND OF THE INVENTION

This invention pertains to the art of railway track assemblies and more particularly, to embedded railway track constructions.

The invention is particularly applicable to a mass transit railway construction in which it is necessary to embed the track so that it does not extend substantially above the finish grade of the surrounding ground surface or pavement. Although the invention will be described with particular reference to an embedded railway construction, it will be appreciated that the invention has broader applications and may be advantageously employed in still other rail environments and applications.

Mass transit railway constructions typically employ a pair of steel rails supported on plural, perpendicularly disposed concrete ties. A resilient and insulating rubber pad is interposed between the bottom flange portion of the generally I-shaped rails and the concrete ties. These rubber pads not only electrically insulate the rail from the concrete ties but provide vertical resilience for the rail. The rubber pads achieve a predetermined degree of noise and vibration attenuation.

Due to the crowded conditions and limited area available for mass transit tracks, it has become increasingly desirable to locate the track in the median strip of a right of way for road traffic. Ideally, this track must also be adapted to permit emergency vehicles to not only cross the track from one side to the other, i.e., in a transverse path along the general direction of the cross ties, but must also be able to adequately support the emergency vehicles for travel in the longitudinal direction, i. e., parallel to the rail direction. Since the rail must accommodate emergency vehicles along its longitudinal path, the track rails must be buried or embedded to prevent substantial interference with driving thereon.

Another important consideration is that the embedded rail constructions be electrically insulated from the surrounding ground. This particularly limits the types of materials that may be used. The embedded track assembly must also be able to withstand predetermined bearing load tests. Additionally, inserts or filler support structures contemplated for insulating along opposite sides of the rails must be able to comply with minimum deflection requirements. Once again, this particularly limits the type of materials that may be used. Also, the rail must have a positive water seal so that moisture will not collect and cause environmental failures.

In addition to being cost effective and easy to install, the proposed inserts must also be able to receive conventional rail clips that are spaced at predetermined areas along the length of the rails. Thus, some type of cavity must be provided in the inserts at these predetermined areas. Simultaneously, the inserts must be able to support the required bearing loads and still meet the minimum deflection requirements at these rail clip areas.

Conventional constructions do not contemplate embedding the rail construction along its entire longitudinal length. Instead, the rails and a portion of the support ties are exposed above the ground surface. Only preselected road crossings need be incorporated into these systems.

Although many railroad crossing structures are known in the art, for example, U.S. Pat. Nos. 4,368,845 issued to Perry, et al. on Jan. 18, 1983; 4,421,272 issued to Whitlock on Dec. 20, 1983; and, 4,445,640 issued to Caillet on May 1, 1984, these types of structures are limited in their use because of the high expense involved in the structures. Further, none of these patents are directed to embedding the entire track construction along its longitudinal length in order to permit not only a transverse crossing of the railways but longitudinal travel by emergency vehicles or other automotive vehicles. The present invention contemplates a new and improved embedded track assembly that overcomes all of the above referred to problems and others and provides a lightweight, durable, and economical structure tailored for use in mass transit railway constructions.

SUMMARY OF THE INVENTION

According to the present invention, there is provided an insert extending along the longitudinal length of the parallel rails for electrically insulating the rails from the surrounding ground surface and provides support with limited deflection to accommodate vehicles in either a transverse or longitudinal direction.

According to a more limited aspect of the invention, the inserts include a generally rigid channel defining an open cavity. An elastomeric member is supported along an upper face of the rigid channel to provide a resilient nature to the insert.

According to a first embodiment of the invention, the rigid member is of metallic construction that is entirely insulated along any area adjacent the associated rail.

According to an alternate embodiment of the invention, the rigid member is of polymeric construction which is itself an electrical insulator.

According to a still further aspect of the invention, a bonding component is used for sealingly interconnecting the rigid member with the elastomeric member.

A principal advantage of the invention resides in the durable structure adapted for transverse and longitudinal vehicle travel.

Another advantage is found in the lightweight construction that facilitates installation.

Yet another advantage is realized by the electrical insulating properties of the assembly.

Still other advantages and benefits will become apparent to those skilled in the art upon a reading and understanding of the following detailed description.

BRIEF DESCRIPTION OF THE DRAWINGS

The invention may take physical form in certain parts and arrangements of parts, preferred and alternate embodiments of which will be described in detail in this specification and illustrated in the accompanying drawings which form a part hereof and wherein.

DETAILED DESCRIPTION OF THE PREFERRED EMBODIMENT

Figure 1:
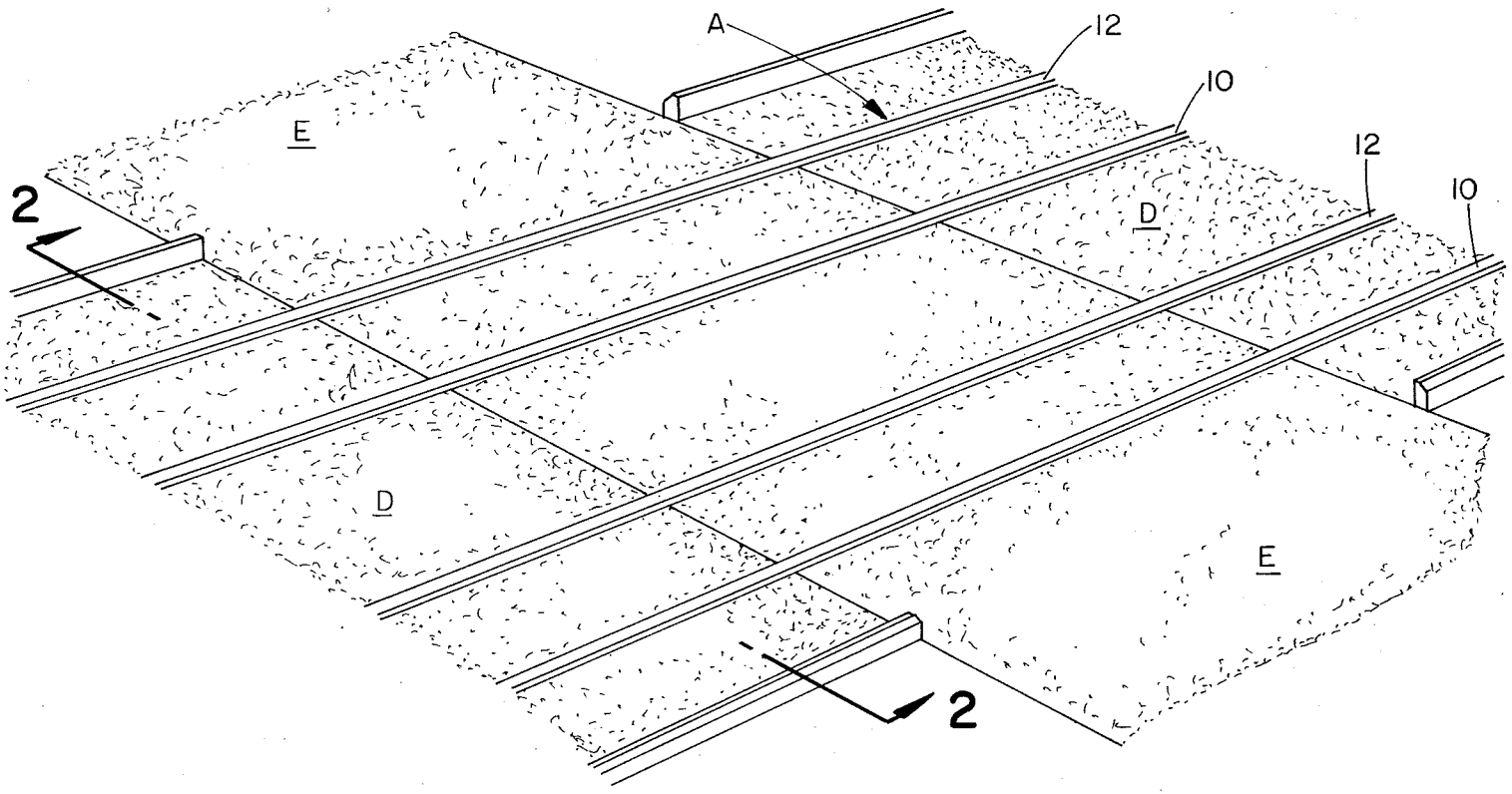
FIG. 1 is a perspective view of an embedded track assembly at a grade crossing according to the subject invention.

Referring now to the drawings wherein the showings are for purposes of illustrating the preferred and alternate embodiments of the invention only and not for purposes of limiting same, the FIGURES show an embedded railway track construction A that electrically insulates the rails from the surrounding ground surface.

More particularly, the embedded track construction A includes first and second rails 10, 12 each having a generally I-shaped cross-section for supporting an associated wheel B of a rail car (not shown). Each rail includes an enlarged support flange 14, top flange 16, and a web 18 interconnecting the top and bottom flanges.

Typically, the bottom flange 14 is operatively supported along spaced support ties 24. Modern day constructions utilize concrete support ties and employ a rubber insulating pad 26 between the concrete ties and the rails, although other support arrangements can be used without departing from the scope and intent of the subject invention. To firmly retain the rails on the concrete ties, conventional rail clips 28 are secured to the ties and extend up and over the bottom support flange 14 to clamp the rails. An insulator 30, such as a glass-filled nylon member is disposed betwen the rail clip and the bottom support flange to electrically insulate the rail from the rail clip and support tie.

As described above, most railway constructions have an open track assembly in which the ties are only partially embedded in the ground surface. In this manner, the rails are fully exposed above the finish grade. As described above and detailed in the noted patents, it is well known to provide a railroad crossing structure that permits traversal of the rails along a path generally perpendicular to the longitudinal direction of the rails. That is, these structures are designed to accommodate automotive traffic in a direction generally parallel to that of the support ties. These structures, though in widespread use, are extremely expensive and not adapted for emergency vehicle travel in a direction generally parallel with the rails. Still further, these structures are only designed for use at selected regions where a roadway crosses or intersects with that of a railroad.

Figure 2:
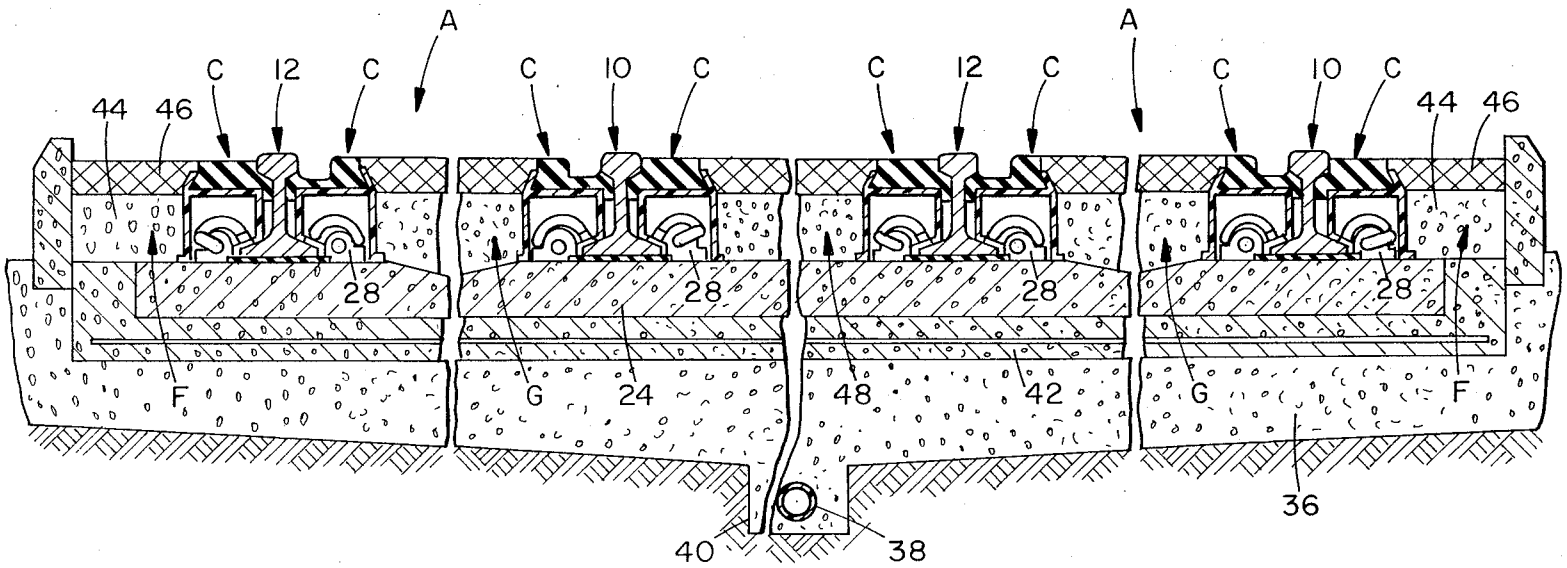
FIG. 2 is a vertical cross-sectional view of the railway track construction generally along the lines 2—2 of FIG. 1.
Figure 3:
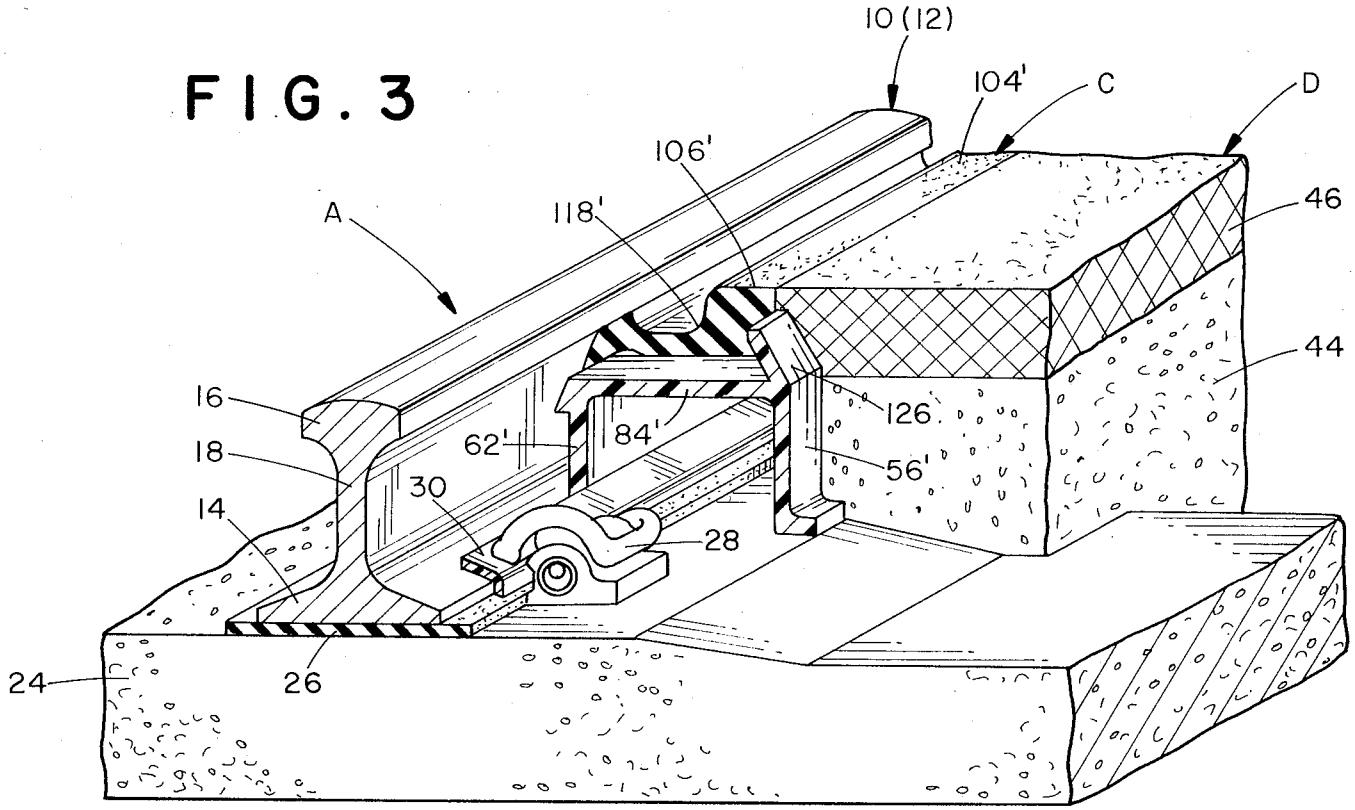
FIG. 3 is an enlarged, perspective view of a preferred insert assembly partially broken away to facilitate illustration of the various components.

According to the subject invention, and as illustrated in FIGS. 1–3, the embedded track assembly includes inserts C extending in operative engagement with opposite sides of each rail along its longitudinal length to entirely insulate the rails from the surrounding ground surface D. As will become more apparent below, the inserts also provide bearing support for emergency vehicles and the like that can travel in the direction of the rails. Alternatively, the inserts permit transverse crossing of the railway, for example, at an intersection with roadway E.

As illustrated in FIGS. 1 and 2, two sets of parallel rails 10, 12 are disposed for railway traffic in two directions. Since the right-hand and left-hand tracks are of identical constructions, like numerals will be used to identify like elements. A crushed rock subgrade 36 receives a drainage pipe 38, such as a perforated polyvinylchloride pipe, in a centralized drainage recess region 40. A reinforced concrete slab 42 is supported on the crushed stone subgrade and, in turn, supports conventional concrete ties 24. Another layer of crushed rock 44 is disposed on top of the support ties and an asphalt pavement 46 defines the finish grade.

The asphalt pavement is disposed on the outer or field side F of the rails, as well as the gauge side G defined between the first and second rails 10, 12. The devil strip region 48 disposed between adjacent rail pairs also incorporates the asphalt pavement. Nevertheless, the compacted stone 44 and asphalt is not brought into engagement with the rails themselves, which are disposed approximately one inch higher than the finish grade of the asphalt pavement. In order to accommodate this difference in height, an insulator not only must electrically insulate the rails from the surrounding ground surface D but must be able to provide limited deflection, e.g., one-quarter inch maximum deflection, so that an automotive vehicle can travel in the same longitudinal direction as that of the rails without adverse effect.

The subject new inserts C are designed for light weight, inexpensive, yet rigid support to provide limited deflection and electrically insulate the rails from the ground surface. A first preferred embodiment shown in FIG. 4 includes a generally rigid member such as an extruded aluminum channel 54. The channel is of hollow configuration and has an inverted, generally U-shaped configuration with a downwardly extending first leg 56 that terminates in an enlarged flange 58. The flange 58 abuttingly engages the top surface of the support tie and is secured thereto with a ram set bolt 60 or other conventional fastening means. A second leg 62 is disposed adjacent the rail and operatively engages the bottom support flange 14 of the rail. The closed end of the rigid channel is defined by a transverse connecting web 64 to substantially close cavity 66 defined by the rigid channel.

The field side and gauge side channels have a slightly different cross-sectional configuration which is most apparent in the connecting web 64. Thus, the differing portions of the connecting web of the field side F and gauge side G channels are referenced by separate numerals for the sake of clarity. The field side channel includes a first inclined portion 72 that extends between the vertical sound leg 62 and a generally horizontal planar region 74. The channel is oriented so that the second leg is substantially positioned between the top and bottom flanges 14, 16 of the rail and generally parallel to the interconnecting web 18 of the rail. From the other end of the planar region 74 extends a vertical portion 76 that merges into a second horizontal portion 78. In this manner, the first leg 56 is connected to the second leg to define a generally inverted U-shaped channel.

The gauge side channel includes first and second horizontal planar regions 84, 86 interconnected by generally vertically extending portion 88. The first planar region 84 defines a recessed area to facilitate receipt of a rail wheel B as will be described further below.

An outwardly extending leg extension 94 of the second leg 62 is received in an elastomeric insulator 96. The insulator 96 has a generally curvilinear interior face that conforms to the arcuate merging area of the interconnecting web 18 and bottom flange 14 of the rail. Additionally, distal end 98 of the insulator abuttingly engages the nylon insulator 30 associated with the rail clips. This abutting engages between the insulators 30, 96 limits horizontal displacement of the second leg 62. Of course, one skilled in the art will realize that the conformation of the second leg might be suitably altered to accommodate other rail fastening arrangements without departing from the scope and intent of the invention. In conjunction with the ram set bolt 60 securing the first leg 56, the entire rigid channel is thereby fixedly secured relative to the rail and support tie.

The second major component of the insert C is an elastomeric slab or pad member 104. On the field side F, the elastomeric member has a generally planar top surface 106 and a downturned region 108 that generally conforms to the vertical portion 76 of the rigid channel. An interior face 110 of the elastomeric member closely conforms and abuttingly engages the generally I-shaped rail as it necks down from the top flange 16 to the web 18. The interior face, though, terminates approximately one-third of the way down the interconnecting web of the rail so that a hollow region 112 is defined between the lower portion of the second leg 62 and the interconnecting web 18.

Likewise, the gauge side elastomeric member also includes a generally planar surface region 106 that extends inwardly from the downturned portion 108 that extends along the first leg 56. The gauge side elastomeric member, though, includes a recess or cut-out 118 that closely follows the vertical portion 88 and the first planar region 84 of the gauge side rigid channel. The cut-out 118 freely receives the flange 120 of associated rail wheel B. Similarly, interior face 110 of the gauge side elastomeric member also generally conforms to the I-shaped rail but terminates approximately one-third of the way down the interconnecting web 18 to define a cavity 112.

A sealing compound 122 is preferably used between the elastomeric member 104 and the rail. The compound is designed to eliminate water penetration through the abutting contact surfaces of the rail and elastomeric member. Likewise, a bonding compound 124 is disposed between the elastomeric member and the generally rigid channel at selected regions to attain a positive bonding relationship therebetween.

Figure 5:
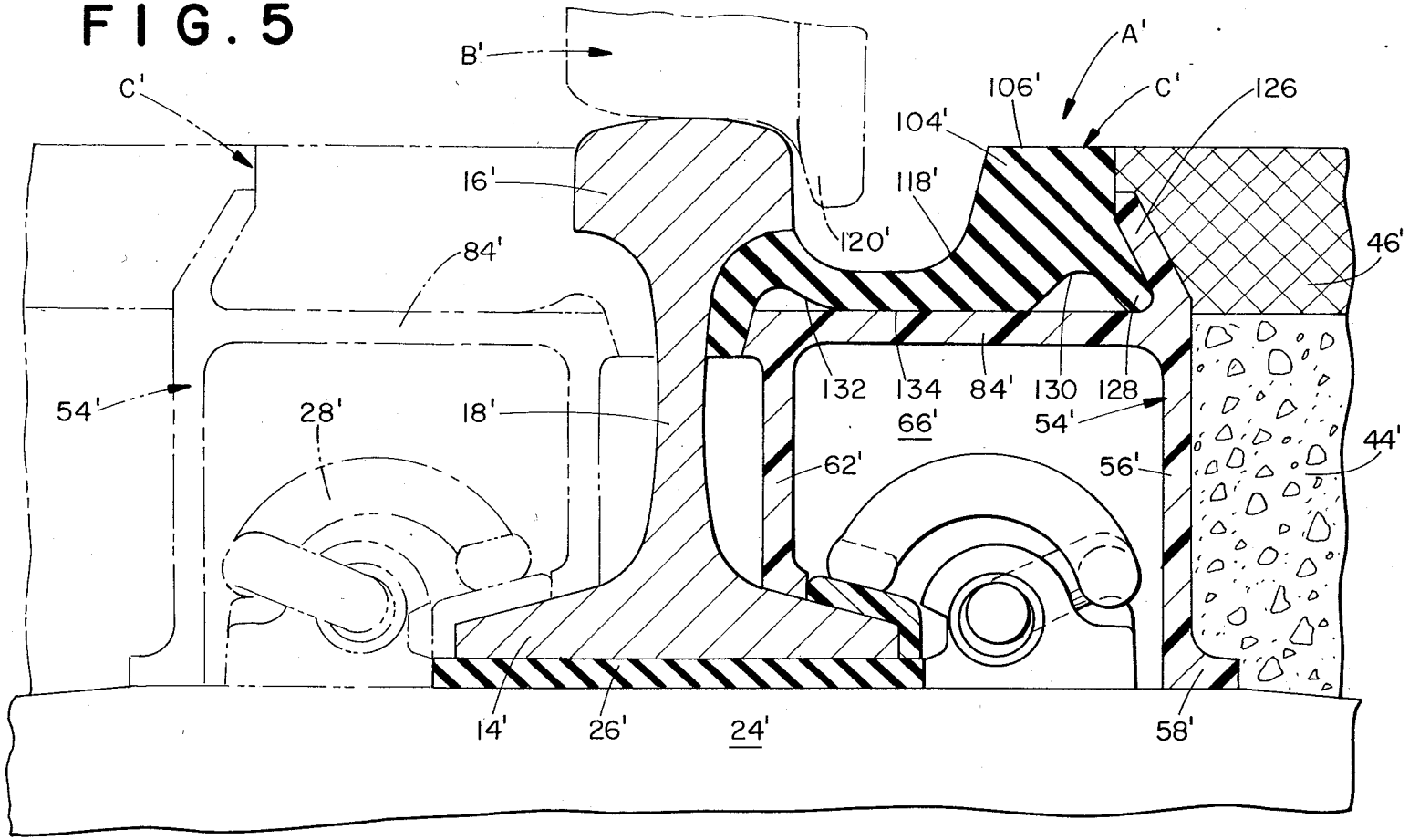

With reference now to FIG. 5, an alternate embodiment will be described in detail. Since a substantial portion of the assembly is similar in construction, like elements are identified by like numerals with a primed (') suffix and new elements are identified by new numerals. The rigid channel is preferably formed of a durable insulating high strength plastic. It is molded to include generally vertically extending first and second legs 56' and 62' interconnected by a planar region 84'. The first leg 56' extends upwardly from abutting engagement with the support tie, while the second leg extends upwardly from abutting engagement with the bottom support flange 14' of an associated rail. An angularly extending leg 126 is inclined inwardly toward the rail from the intersection of the first leg portion and the planar region. The angular leg defines an acute angle with planar region 84' and forms a locking arrangement with the elastomeric member 104'.

The elastomeric member includes a generally planar surface 106'. Likewise, the gauge side has a recess or cut-out 118'. Once again, the cut-out is designed to receive the flange 120' of an associated rail wheel B'. Since the rigid channel 54' is of plastic construction the insulator, disposed at the lower end of the second leg in the FIG. 4 embodiment, is not required. Instead, the second leg directly abuts the bottom support flange 14' of the rail.

A finger portion 128 is formed in the elastomeric member 104' for cooperation with the angular leg 126 of the rigid plastic channel. The finger extends downwardly and outwardly away from the rail and is lockingly engaged by the angular leg of the rigid channel. More particularly, the asphalt 46' imposes a vertical downward bearing force component on the angular leg to lock the finger in place and prevent upward removal of the elastomeric member. Additionally, the lateral pressure imposed by the compacted stone and asphalt retains the entire insert firmly pressed against the associated rail. Further, the terminating support flange 58' of the first leg anchors the rigid channel against displacement.

A pair of upwardly extending recesses 130, 132 are formed in the lower face 134 of the elastomeric slab. The first recess 130 facilitates removal of the entire elastomeric slab in case of repair. That is, if a lifting force is applied to the elastomeric slab, the groove 130 will permit the finger 128 to extend inwardly toward the rail and be relieved of its locking engagement with the angular leg. The second recess 132 permits adequate deflection when the rail is loaded under vertical bearing forces and vibratory movements. In all other aspects, the second embodiment is substantially similar to that of the first embodiment.

Figure 4:
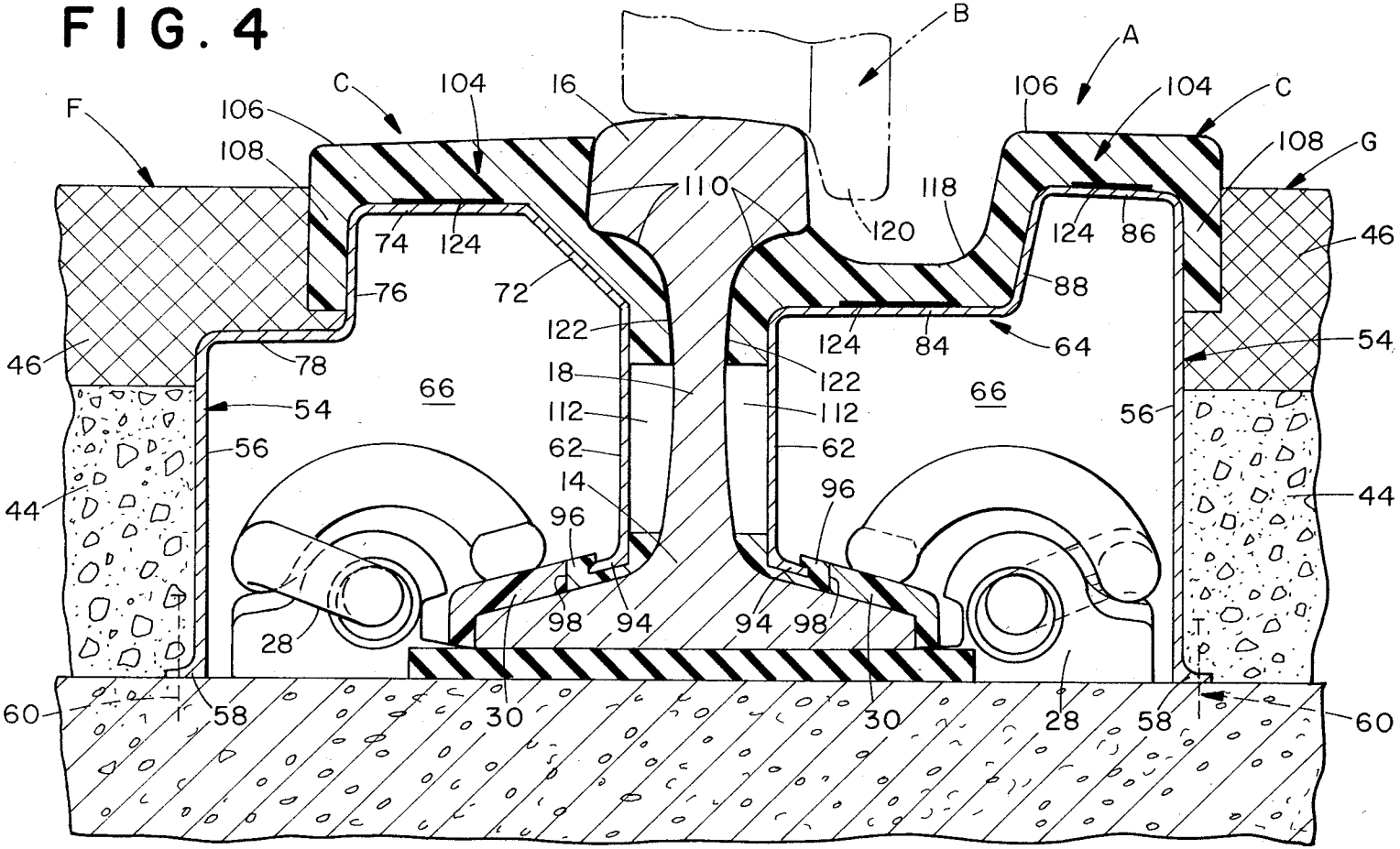
FIG. 4 is an enlarged, cross-sectional view of a first preferred embodiment of the subject invention; and, FIG. 5 is an enlarged, cross-sectional view of a second preferred embodiment.

According to the above-detailed embodiments, the following particulars more specifically describe the type of materials used:

| | |
|---|---|
| FIG. 4 Embodiment: | |
| Rigid channel | Aluminum alloy, metal alloy |
| Elastomeric member | Thermal setting or thermal plastic |
| Sealing compound | Cohesive elastomeric material |
| Bonding compound | Cohesive elastomeric material |
| FIG. 5 Embodiment: | |
| Rigid channel | Thermal setting or thermal polymeric material |
| Elastomeric member | Thermal setting or thermal plastic |
| Sealing compound | Cohesive elastomeric material |
| Bonding compound | Cohesive elastomeric material |

The invention has been described with reference to the preferred and alternate embodiments. Obviously, modifications and alterations will occur to others upon a reading and understanding of this specification. For example, other light weight rigid materials than aluminum or plastic can be used with equal success. Similarly, other compositions can be substituted for the described elastomer without departing from the scope and intent of the subject invention. This specification is intended to include all such modifications and alterations insofar as they come within the scope of the appended claims or the equivalents thereof.

Having thus described the invention, is is now claimed:

1. An insulated embedded track construction for a transit railway comprising:

first and second spaced, generally parallel rails extending for an indefinite length in a first longitudinal direction;

plural, spaced ties disposed generally perpendicular to the rails in supporting relation thereof;

plural rail clips secured to said ties and engaging said rails at spaced positions along said first direction for fastening said rails to said ties; and, a first composite insert disposed in abutting engagement with said first rail, said first insert extending continuously along said indefinite length in said first longitudinal direction, said composite insert including a first, generally rigid channel having first and second legs extending outwardly from a connecting portion and defining a cavity for receiving said rail clips, and an elastomeric member cooperating therewith.

2. The track construction as defined in claim 1 further comprising second, third, and fourth composite inserts extending said indefinite length in said first longitudinal direction, each of said second, third and fourth inserts including a first generally rigid channel and an elastomeric member cooperating therewith.

3. The track construction as defined in claim 2 wherein said first and second inserts are disposed in abutting engagement with said first and second rails, respectively, along inner faces of said rails, said first and second inserts each including an arcuate cut-out for receiving an associated wheel flange of the transit railway.

4. The track construction as defined in claim 1 wherein said second leg operatively engages a bottom flange of the first rail.

5. The track construction as defined in claim 4 further comprising an insulator interposed between said second leg and said bottom flange of the first rail.

6. The track construction as defined in claim 1 wherein said first leg operatively engages said ties.

7. The track construction as defined in claim 6 further comprising a leg extension extending outwardly from said connecting portion oppositely from said first leg.

8. The track construction as defined in claim 7 wherein said leg extension defines an acute angle with said connecting portion.

9. The track construction as defined in claim 1 wherein said elastomeric member abuttingly engages said rigid channel along said connecting portion.

10. The track construction as defined in claim 1 wherein said rigid channel is an aluminum composition.

11. The track construction as defined in claim 1 wherein said rigid channel is of plastic composition.

12. The track construction as defined in claim 1 further comprising a bonding component for sealingly interconnecting said rigid channel and elastomeric member.

13. The track construction as defined in claim 1 further comprising an insulator operatively disposed at an outer terminal end of said rigid channel for electrically insulating said channel from said first rail.

14. The track construction as defined in claim 1 further comprising a sealing compound for sealingly interconnecting said elastomeric member and said first rail.

15. The track construction as defined in claim 14 wherein said elastomeric member closely conforms and abuttingly engages said first rail from a rail top flange to a rail web.

16. The track construction as defined in claim 15 wherein said elastomeric member terminates approximately one-third of the way down said rail web to define a hollow region between said second leg and said rail web.

17. The track construction as defined in claim 1 wherein said second leg of said channel is substantially disposed between a top flange and a bottom flange of said first rail.

18. An embedded railway track construction comprising:

first and second substantially parallel rails defining a longitudinal path of indefinite length;

ties supportingly engaging said first and second rails;

means for fastening said rails to said ties; and, an insert having a continuous longitudinal dimension substantially co-terminuous with said first and second rails, said insert including a first generally rigid portion having first and second legs extending outwardly from a connecting portion and defining a cavity for receiving said fastening means, said insert further including an elastomeric member operatively engaging said rigid channel along a first face that is oppositely disposed from said cavity.

19. The embedded track construction as defined in claim 18 wherein said first leg operatively engages said ties and said second leg operatively engages a bottom flange of said first rail.

20. The embedded track construction as defined in claim 19 further comprising an insulator interposed between a terminal end of said second leg and said bottom flange of said first rail.

21. The embedded track construction as defined in claim 18 wherein said elastomeric member includes an arcuate cut-out for receiving an associated railway wheel flange.

* * * * *